US010240869B2

(12) United States Patent
Gärdin

(10) Patent No.: US 10,240,869 B2
(45) Date of Patent: Mar. 26, 2019

(54) PRESSING ARRANGEMENT FOR TREATING SUBSTANCES

(75) Inventor: Mats Gärdin, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 939 days.

(21) Appl. No.: 14/006,872

(22) PCT Filed: Mar. 21, 2011

(86) PCT No.: PCT/EP2011/001386

§ 371 (c)(1),
(2), (4) Date: Sep. 15, 2014

(87) PCT Pub. No.: WO2012/126482

PCT Pub. Date: Sep. 27, 2012

(65) Prior Publication Data

US 2015/0079528 A1 Mar. 19, 2015

(51) Int. Cl.
*B22F 3/14* (2006.01)
*F27D 7/06* (2006.01)
(Continued)

(52) U.S. Cl.
CPC ..... *F27D 7/06* (2013.01); *B22F 3/15* (2013.01); *B30B 11/002* (2013.01);
(Continued)

(58) Field of Classification Search
USPC ..... 432/24, 200, 72
See application file for complete search history.

(56) References Cited

U.S. PATENT DOCUMENTS 4,268,708 A 5/1981 Smith, Jr. et al.
4,666,314 A 5/1987 Tojyo et al.
(Continued)

FOREIGN PATENT DOCUMENTS

EP 1214166 B1 8/1999
JP 55-112136 A 8/1980
(Continued)

OTHER PUBLICATIONS

Decision on Grant Patent for Invention for Application No. 2013145866/02, dated Mar. 21, 2011, 15 pages.
(Continued)

*Primary Examiner* — Steven B McAllister
*Assistant Examiner* — John Bargero
(74) *Attorney, Agent, or Firm* — Wolf, Greenfield & Sacks, P.C.

(57) ABSTRACT

The present invention relates to a pressing arrangement for treatment of articles by hot pressing and in particular to a pressing arrangement for hot isostatic pressing of containers holding substances. The method comprises: placing containers including the substance in a load compartment in the furnace and loading a pressure medium into the pressure vessel and substantially all pressure medium flowing out from the furnace chamber (18) passes at least one substance capturing module, which may include the walls of the guiding passage, at least one condensation element (35) in the guiding passage, filters (41, 43) arranged in the guiding passage, before making contact with the pressure vessel including the top and bottom closures (8, 9).

14 Claims, 4 Drawing Sheets

(51) Int. Cl.

| | |
|---|---|
| ***B22F 3/15*** | (2006.01) |
| ***B30B 11/00*** | (2006.01) |
| ***B30B 15/00*** | (2006.01) |
| ***F27D 5/00*** | (2006.01) |
| ***F27D 21/00*** | (2006.01) |

(52) U.S. Cl.
CPC ..... *B30B 15/0082* (2013.01); *F27D 5/00* (2013.01); *F27D 21/00* (2013.01); *F27D 2007/063* (2013.01)

(56) References Cited

U.S. PATENT DOCUMENTS

| | | | | |
|---|---|---|---|---|
| 4,897,528 | A * | 1/1990 | Anthony | F27D 17/008 219/393 |
| 4,938,673 | A | 7/1990 | Adrian | |
| 5,118,289 | A * | 6/1992 | Bergman | B22F 3/15 419/25 |
| 5,123,832 | A * | 6/1992 | Bergman | B01J 3/04 219/400 |
| 6,250,907 | B1 * | 6/2001 | Bergman | B22F 3/15 219/400 |
| 7,758,338 | B2 * | 7/2010 | Hsiao | H01L 21/67017 432/198 |
| 2003/0215539 | A1 * | 11/2003 | Manabe | F27D 7/04 425/405.2 |
| 2006/0201221 | A1 * | 9/2006 | Sehlstedt | B22F 3/15 72/201 |

FOREIGN PATENT DOCUMENTS

| | | | |
|---|---|---|---|
| JP | 63-041786 | A | 2/1988 |
| RU | 2245221 | C2 | 12/2003 |
| RU | 2302924 | C2 | 5/2005 |
| WO | WO 03070402 | A1 | 8/2003 |

OTHER PUBLICATIONS

International Search Report from parent application PCT/EP2011/001386, dated Mar. 21, 2011, pp. 1-5.

* cited by examiner

PRESSING ARRANGEMENT FOR TREATING SUBSTANCES

RELATED APPLICATIONS

This patent application is a national stage filing under 35 U.S.C. § 371 of international PCT application PCT/EP2011/001386, filed Mar. 21, 2011, the entire contents of which is incorporated herein by reference.

TECHNICAL FIELD OF THE INVENTION

The present invention relates to a pressing arrangement for treatment of articles by hot isostatic pressing.

BACKGROUND OF THE INVENTION

Hot isostatic pressing (HIP) is a technology that finds more and more widespread use. Hot isostatic pressing is for instance used in achieving elimination of porosity in castings, such as for instance turbine blades, in order to substantially increase their service life and strength, in particular the fatigue strength. Another field of application is the manufacture of products, which are required to be fully dense and to have pore-free surfaces, by means of compressing powder.

Furthermore, yet another application is treatment of a load containing substances that, untreated, may emit volatile gases or dust in order to make them compact and dense and thereby eliminate or at least significant reduce their ability to make dust or emit substances. Thereby, the ability of the treated substances to endure storage and withstand impact from environmental factors such as oxygen and water is also significantly improved. This, in turn, improves the long-term stability of the treated substances and enables storage over long periods of time.

In certain applications, the substances are dangerous, e.g. radioactive materials or substances or poisonous or toxic material or substances, which entails that the handling of the substance has to be very careful in order to avoid, for example, any dust making. This applies during transport and storage of the substance, as well as during loading of the substances into the pressing arrangement, the actual treatment of the substance in the pressing arrangement and unloading of the substances. To this end, the substance is placed in sealed containers and the substance is kept within the containers during transport, treatment and storage.

In a hot isostatic pressing process, the containers are typically placed in a load compartment of an insulated pressure vessel. A cycle, or treatment cycle, comprises the steps of: loading, treatment and unloading of containers, and the overall duration of the cycle is herein referred to as the cycle time. The treatment may, in turn, be divided into several portions, or stages, such as a pressing stage, a heating stage, and a cooling stage.

After loading, the vessel is sealed off and a pressure medium is introduced into the pressure vessel and the load compartment thereof. The pressure and temperature of the pressure medium is then increased, such that the containers are subjected to an increased pressure and an increased temperature during a selected period of time. The temperature increase of the pressure medium, and thereby of the substance, is provided by means of a heating element or furnace arranged in a furnace chamber of the pressure vessel. The pressures, temperatures and treatment times are of course dependent on many factors, such as the material properties of the treated substance.

When the pressing treatment of the substance is finished, the containers including the substance often need to be cooled before being removed, or unloaded, from the pressure vessel.

In case of a container failure during the treatment of the substance in the pressing arrangement, there is an evident risk that substances leak from the damaged containers and contaminate the pressing arrangement, or in worst case, contaminate the surrounding environment. If the failure occurs at a high pressure, the effects may be very serious or even fatal. If the pressing arrangement is completely contaminated, the process of cleaning or decontaminating the pressing arrangement would be very expensive and parts of the pressing arrangement would have to be replaced and in worst case the pressing arrangement has to be destructed. If the substance leaks out from the pressing arrangement and into the surrounding environment, the effects on the environment may be very severe in case of a radioactive or poisonous substance.

Accordingly, it is of a very high importance that the effects of a potential container failure are kept at minimum and that the treated substance, in particular in case of a dangerous substance such as a radioactive substance, is isolated within the pressing arrangement in as small region as possible to avoid that the substance is spread in an uncontrolled manner in the pressing arrangement and in worst case further out in the surrounding environment.

SUMMARY OF THE INVENTION

A general object of the present invention is to provide a method and a pressing arrangement for secure hot isostatic pressing treatment of volatile substances, at high temperatures, or dust making substances, in particular, radioactive or poisonous substances.

A further object of the present invention is to provide a method and pressing arrangement for hot isostatic pressing treatment of volatile substances, at high temperatures, or dust making substances, in particular, radioactive or poisonous substances, where a spreading of the treated substance in case of a container failure, e.g. container leakage or container explosion, can be limited within the pressing arrangement.

Another object of the present invention is to provide a method and pressing arrangement for hot isostatic pressing treatment of volatile substances, at high temperatures, or dust making substances, in particular, radioactive or poisonous substances, so as to make the substance chemically stable after the treatment.

A further object of the present invention, is to provide a method and pressing arrangement for hot isostatic pressing treatment of volatile substances, at high temperatures, or dust making substances, in particular, radioactive or poisonous substances, so as to increase the ability of the substances to withstand environmental influence from, for example, oxygen or water.

Yet another object of the present invention is to provide a method and pressing arrangement for hot isostatic pressing treatment of volatile substances, at high temperatures, or dust making substances, in particular, radioactive or poisonous substances, to enable long-term storage of the substances in containers with a significantly increased level of security after the treatment.

A further object of the present invention is to provide a method and pressing arrangement for hot isostatic pressing treatment of volatile substances, at high temperatures, or dust making substances, that increases the production security and reduces the risk for production stop.

These and other objects of the present invention are achieved by means of a pressing arrangement having the features defined in the independent claims. Embodiments of the present invention are characterized in the dependent claims.

In the context of the present invention, the terms "cold" and "hot" or "warm" (e.g. cold and warm or hot pressure medium or cold and warm or hot temperature) should be interpreted in a sense of a comparison to an average temperature within the pressure vessel. Similarly, the term "low" and high" temperature should also be interpreted in a sense of a comparison to an average temperature within the pressure vessel.

In the context of the present invention, the term "substance" should be interpreted as including inter alia a fluid, a gas, droplets, or particles.

According to an aspect of the present invention, there is provided a pressing arrangement for hot isostatic pressing of substances comprising a pressure vessel including top and bottom end closures. A furnace chamber is provided inside the pressure vessel and is adapted to hold articles such as containers comprising substances to be treated by hot pressing. A heat insulated casing including a heat insulating portion, a housing and a bottom heat insulating portion is arranged to surround the furnace chamber. The heat insulating portion and the housing is arranged such that a guiding passage is formed in between and the guiding passage communicates with the furnace chamber and is a part of an outer cooling loop, wherein the pressure medium is guided toward the top closure in the first guiding passage. At least one hole is arranged substantially at the same height as the bottom heat insulating portion to allow warm pressure medium to flow into the guiding passage from the furnace chamber. At least one substance capturing module is adapted to capture substances carried by the pressure medium and is arranged such that substantially all pressure medium flowing out from the furnace chamber passes the at least one capturing module before making contact with the pressure vessel including the top and bottom closures.

According to a second aspect of the present invention, there is provided a method for hot isostatic pressing of substances using a pressing arrangement including a pressure vessel including top and bottom end closures. A furnace chamber is provided inside the pressure vessel and is adapted to hold articles such as containers comprising substances and a heat insulated casing including a heat insulating portion, a housing and a bottom heat insulating portion are arranged to partly enclose the furnace. The method comprises: (i) placing containers including the substance in a load compartment in the furnace; (ii) loading a pressure medium into the pressure vessel; (iii) pressurizing the pressure vessel to a pressure between 200 to 5000 bars, and preferably 800 to 2000 bars, and more preferably 500 to 1500 bars; (iv) maintaining temperature in the pressure vessel from between 300° C. to 3000° C., and preferably from 800° C. to 2000° C.; (v) securing that substantially all pressure medium flowing out from the furnace chamber passes at least one substance capturing module, which may include the walls of the guiding passage, at least one condensation element in the guiding passage, filters arranged in the guiding passage, before making contact with the pressure vessel including the top and bottom closures; (vi) reducing the temperature with the pressure vessel; (vii) releasing pressure from the pressure vessel; and (viii) unloading the containers including the treated substance.

The present invention is generally based on the idea of treating dust making or volatile substances (volatile at high temperatures), in particular dangerous substances such as radioactive substances, with hot isostatic pressure, e.g. pressures between 200 to 5000 bars, and preferably 800 to 2000 bars, and more preferably between 500 to 1500 bars and temperatures from between 300° C. to 3000° C., and preferably from 800° C. to 2000° C., to make a treated substance chemically stable to thereby significantly increase the ability of the substance to withstand influences from environmental factors such as oxygen or water. This, for example, enables a secure long-term storage of the treated substance.

High pressure treatment of in particular dangerous substances put very high requirements on the pressing arrangement with regard to secure handling of the substances during, for example, loading, treatment and unloading of container including the substances. These high security requirements particularly apply to minimizing or eliminating the risks for an uncontrolled spreading of substances in case of a container leakage or container explosion.

Having these high standards and requirements with regard to secure handling of the substances during loading and un-loading as well as during the treatment in mind, the inventive pressure arrangement described herein has been developed. The ideas behind this inventive pressing arrangement is to design and arrange the pressing arrangement such that a spreading of substances resulting from a container leakage or container explosion is limited to a region within the pressing arrangement and particularly within a region inside the housing and bottom heat insulation portion. To this end, at least one substance capturing module is adapted to capture substances carried by the pressure medium and the capturing module (or elements) is arranged such that substantially all pressure medium flowing out from the furnace chamber is conveyed the at least one capturing module before making contact with the pressure vessel including the top and bottom closures. Thereby, a very large proportion of substances in the pressure medium, e.g. dust or gaseous contaminates in the pressure medium resulting from a container leakage, can be captured before making contact with the pressure vessel. Consequently, the risk for a contamination of the pressure vessel can be eliminated or at least significantly reduced. This, in turn, eliminates or significantly reduces the risk for a leakage out from the pressure vessel.

Furthermore, the present invention additionally allows rapid cooling and ultra rapid cooling of the load and pressing arrangement. This, in turn, enables an unload of the load of the pressing arrangement after a relatively short period of time after the treatment has been finished, which inter alia increases the productivity of the pressing arrangement since it shortens the overall cycle time significantly.

In an embodiment of the present invention, a sealing is arranged between the furnace chamber and a space below the bottom heat insulating portion where the pressure medium is cold. Thereby, substances from a leaking container cannot fall or otherwise be transported directly in downward direction to make contact with the bottom closure of the pressure vessel.

According to embodiments of the present invention, the at least one substance capturing module is arranged in the outer cooling circuit such that substantially all pressure medium flowing out from the furnace chamber is conveyed to pass by or through the at least one capturing module via the guiding channel before making contact with the pressure vessel.

According to embodiments of the present invention, the at least one substance capturing module comprises at least one condensation element arranged in the first guiding passage, wherein substances carried by the pressure medium can condensate on the condensation element when passing the condensation element. Alternatively or as a complement, the walls of the guiding passage (i.e. the walls of the housing and the heat insulating portion) can function as condensation elements.

According to embodiments of the present invention, the at least one substance capturing module comprises at least one first filter arranged downstream the at least one upper hole.

According to embodiments of the present invention, the at least one first filter is arranged downstream the condensation element and is arranged such that the pressure medium passes through the filter before making contact with the pressure vessel including the top and bottom closures.

According to embodiments of the present invention, the at least one first filter is arranged in the guiding passage between the at least one upper hole and at least one opening in an upper part of the guiding passage.

According to embodiments of the present invention, at least one lower hole is arranged below the at least one upper hole in a lower part of the guiding passage.

According to embodiments of the present invention, the at least one lower hole is arranged below the sealing to allow colder pressure medium to flow into the guiding passage from the space below the bottom heat insulating portion to mix with hot pressure medium flowing into the guiding passage from the furnace chamber. Thereby, for example, an efficient condensation of substances carried by the hot pressure medium on, for example, a condensation element arranged in the guiding passage and/or on the walls of the guiding passage.

According to embodiments of the present invention, the at least one substance capturing module comprises at least one second filter is arranged in connection with the at least one lower hole such that substances carried by pressure medium are substantially prevented from entering the space below the bottom heat insulating portion.

According to an embodiment of the present invention, the least one second filter is arranged in the guiding passage.

In embodiments of the present invention, the first and/or second filter is an electro-static filter or a chemically active filter.

According to an embodiment of the present invention, it is secured or assured that substantially all pressure medium flowing out from the furnace chamber is conveyed to pass the at least one substance capturing module via the guiding channel before making contact with the pressure vessel.

According to embodiments of the present invention, it is secured that substantially all the pressure medium flowing out from the furnace chamber is conveyed to pass at least one condensation element of the substance capturing module arranged in the first guiding passage, wherein substances carried by the pressure medium can condensate on the condensation element when passing the condensation element.

According to embodiments of the present invention, it is secured that substantially all pressure medium flowing out from the furnace chamber is conveyed to pass at least one first filter arranged downstream the at least one upper hole.

According to an embodiment of the present invention, it is secured that cold pressure medium is conveyed through at least one lower hole arranged below a sealing between the furnace chamber and a space below the bottom heat insulating portion to flow into the guiding passage from the space below the bottom heat insulating portion.

In specific embodiments of the present invention, the substance is a compound comprising caesium including numerous binary compounds of caesium and oxygen.

Features from two or more embodiments outlined above can be combined, unless they are clearly complementary, in further embodiments. Likewise, the fact that two features are recited in different claim does not preclude that they can be combined to advantage. For example, a condensation element can be used together with the first and/or second filter. Moreover, the first and second filters can be used without the condensation element.

BRIEF DESCRIPTION OF FIGURES

Embodiments of the present invention will now be described with reference to the accompanying drawings, on which.

DETAILED DESCRIPTION OF EMBODIMENTS

Figure 1:
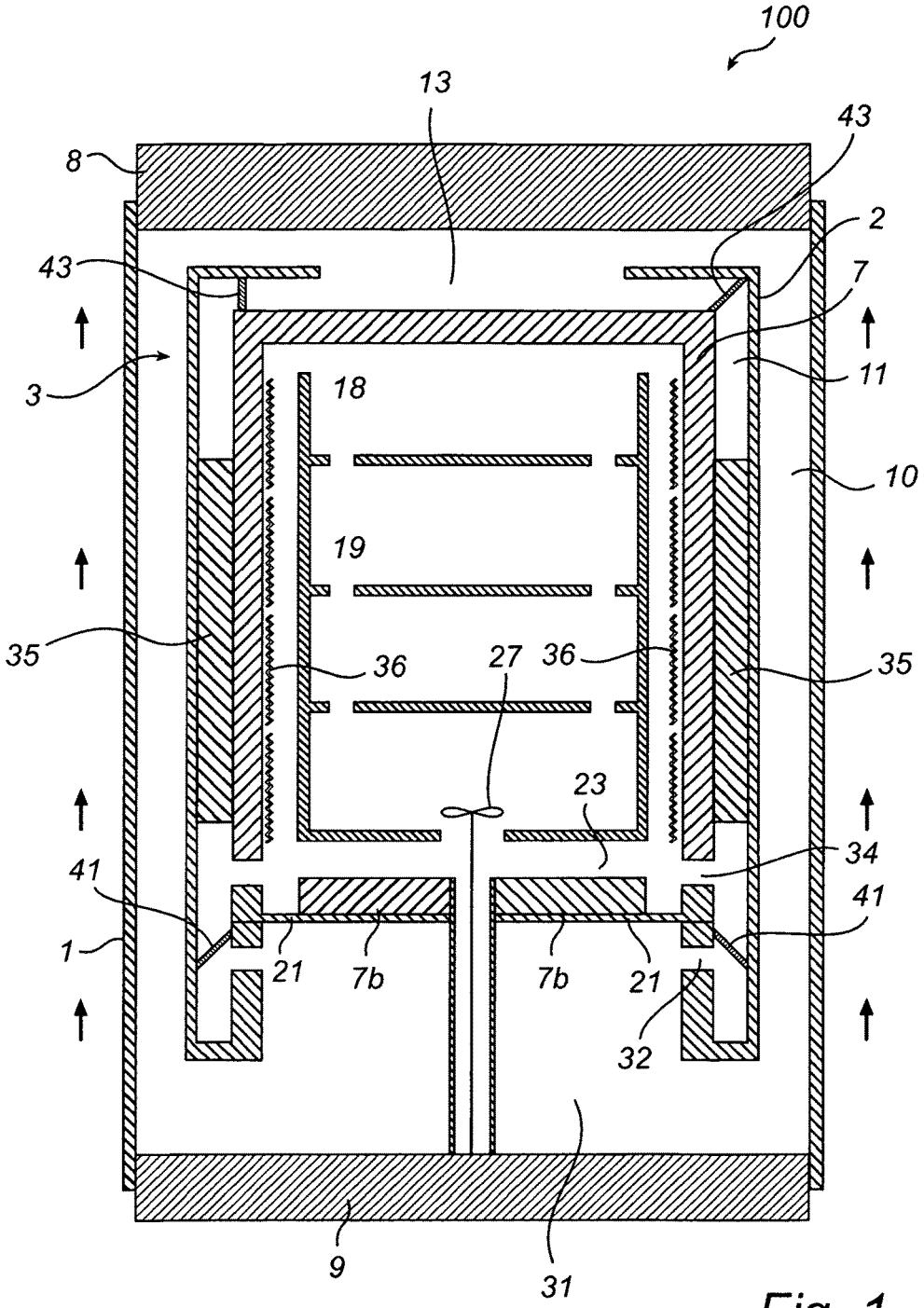
FIG. 1 is a schematical side view of a pressing arrangement according to an embodiment of the present invention.

The following is a description of exemplifying embodiments of the present invention. This description is intended for the purpose of explanation only and is not to be taken in a limiting sense. It should be noted that the drawings are schematic and that the pressing arrangements of the described embodiments comprise features and elements that are, for the sake of simplicity, not indicated in the drawings.

With reference first to FIG. 1, a pressure arrangement in which the present invention is implemented will be discussed. The pressing arrangement 100, which is intended to be used for hot isostatic pressing of substances that may be of volatile, at high temperatures, or that may emit dust and, in particular, dangerous substances such as radioactive substances. The pressing arrangement 100 comprises a pressure vessel 1 with means (not shown), such as one or more ports, inlets and outlets, for supplying and discharging a pressure medium.

The pressure vessel 1 is provided with top and bottom end closures 8 and 9, respectively.

The pressure medium may be a liquid or gaseous medium with low chemical affinity in relation to the articles to be treated.

The pressure vessel 1 includes a furnace chamber 18, which comprises a furnace (or heater) 36, or heating elements, for heating of the pressure medium during the pressing state of the treatment cycle. The furnace 36 is, as shown in for example FIG. 1, located at the sides of the furnace chamber 18. It may however be located at the lower portion of the furnace chamber 18 (not shown). The person skilled in the art realises that it is also possible to combine heating elements at the sides with heating elements at the bottom so as to achieve a furnace which is located at the sides and at the bottom of the furnace chamber. Clearly, any implementation of the furnace regarding placement of heating elements, known in the art, may be applied to the embodiments shown herein. It is to be noted that the term "furnace" refers to the means for heating, while the term "furnace chamber" refers to the volume in which load and furnace are located. The furnace chamber 18 does not occupy the entire pressure vessel 1, but leaves an intermediate space or first guiding passage 10 around it. The first guiding passage 10 is used as guiding passage in an outer cooling loop as indicated in FIG. 1 by the arrows. During normal operation of the pressing arrangement, the first guiding passage 10 is typically cooler than the furnace chamber 18 but is at equal pressure.

The furnace chamber 18 further includes a load compartment 19 for receiving and holding articles 5 to be treated. According to the invention, the load compartment 19 may be specifically adapted and designed to receive and hold containers including the substance to be treated, for example, a radioactive or poisonous substance.

The furnace chamber 18 is surrounded by a heat insulated casing 3, which is likely to save energy during the heating state. It may also ensure that convection takes place in a more ordered manner. In particular, because of the vertically elongated shape of the furnace chamber 18, the heat insulated casing 3 may prevent forming of horizontal temperature gradients, which are difficult to monitor and control. The bottom of the heat insulated casing 3 comprises a bottom heat insulating portion 7*b*.

Fittings inside the pressure vessel 1—including the load compartment 19, casing 3, heat insulating portion 7, any apertures between the furnace chamber 18 and the first guiding passage 10 and even adjustable valves—will form guiding flow channels or otherwise play the role as guiding means for streams of pressure medium when such arise as a consequence of convective or forced flow from a fan (27), for example. It should be noted, that the disclosed layout of the fittings may be varied in a number of ways, e.g., to satisfy specific needs.

The bottom heat insulation portion 7*b* is arranged on a sealing or bottom plate 21 substantially isolating the furnace chamber 18 from a space 31 below the bottom heat insulating portion 7*b*. Hence, the bottom plate 21 is arranged in contact with a heat insulating portion 7 of the heat insulated casing 3 and/or the housing 2 to provide a sealing between an upper space 23 below the furnace chamber 18 and a lower space 31 below the bottom heat insulation portion 7*b*. In an alternative embodiment, the bottom heat insulation portion 7*b* is arranged to provide the sealing between the upper space 23 and the lower space 31.

Furthermore, the pressure vessel 1 may be provided with one or more cooling circuits including channels or tubes, in which a coolant for cooling may be provided. In this manner, the vessel wall may be cooled in order to protect it from detrimental heat. The flow of coolant is indicated in FIG. 1 by the arrows on the outside of the pressure vessel. The use of an external cooling circuit enables efficient cooling even though the pressure vessel can be carefully heat insulated for energy-economical operation. Preferably, the guiding means are arranged in such manner that the pump forces a convective circulation loop of which a substantive portion is proximate to the externally cooled outer wall of the pressure vessel. This causes heat transfer away from the hot articles and out of the pressure vessel.

The heat-insulated casing 3 of the furnace chamber 18 is accompanied by a housing 2, which includes one or several apertures 13 in an upper part of the heat insulated casing 3, for adding another layer to the circulation loop.

A second guiding passage 11 is formed between the housing 2 of the furnace chamber 18 and the heat insulating portion 7 of the furnace chamber 18. The second guiding passage 11 is used to guide the pressure medium towards the top end closure 8 of the pressure vessel (or alternatively towards the pressure vessel wall, which is not shown herein) via the at least one aperture 13. Thus, in addition to the internal circulation inside the furnace chamber 18, the pressure medium is guided substantially upwards in the second guiding passage 11 formed between the casing 3 and the housing 2, and substantially downwards in the first guiding passage 10, between the housing and the outer wall of the pressure vessel 1 in an outer cooling loop. It is noted that one portion of the internal circulation is guided back into the furnace chamber 18, whereas a second portion joins the upward flow between the housing 2 and the casing 3, and a third portion flows directly into the first guiding passage 10. The proportion of these three flows can be adjusted by varying the spacing between a bottom heat insulating portion 7*b*, the housing 2 and the casing 3.

Pressure medium can flow into the second guiding passage 11 from the lower space 31 via at least one lower hole or aperture 32 arranged below a sealing 21, and preferably arranged below the bottom heat insulation portion 7*b*. In the embodiment of FIG. 1, the at least lower one hole 32 (or set of holes or apertures) is arranged in the housing 2 but may however be arranged in the heat insulated portion 7 depending on the specific construction, for example, in a construction where the bottom heat insulating portion 7*b* extends below the bottom plate or sealing 21.

The lower holes 32 allow an inflow of cold pressure medium into the guiding passage 11, e.g. pressure medium having a temperature of about 150° C., so as to mix with the flow of hot pressure medium from the furnace chamber 18, e.g. pressure medium having a temperature of about 1100° C., into the second guiding passage 11 via holes 34 arranged above the sealing 21 but below an upper surface 23 of the bottom heat insulating portion 7*b*. Thereby, it is possible to obtain a temperature of the pressure medium ascending in the guiding passage 11 that enables an efficient condensation of any substances carried by the pressure medium on, for example, a condensation element 35 arranged in the guiding passage 11 and/or on the walls of the guiding passage (i.e. the walls of the housing 2 and the heat insulating portion 7).

Thus, warm pressure medium is allowed to flow into the second guiding passage 11 from the upper space 23 via at least one upper hole or aperture 34 (or set of holes or apertures) arranged substantially at the same height as the bottom heat insulation portion 7*b*. The at least one upper hole 34 is arranged in the heat insulated portion 7 below an upper surface 22 of the bottom heat insulation portion 7*b*.

The lower and upper holes 32, 34 may have, for example, circular apertures, square-shaped apertures, or rectangular-shaped (or elongated) apertures.

According to the present invention, at least one substance capturing module, 35, 41, 43 is adapted to capture substances from the substance carried by the pressure medium resulting from a container leakage. As a complement to, or as an alternative to, the walls of the guiding passage 11, i.e. the walls of the housing 2 and the heat insulating portion 7, may function as condensation elements in that substances carried by the passing pressure medium may condensate on the walls.

The at least one substance capturing module 35, 41, 43 is arranged such that substantially all pressure medium flowing out from the furnace chamber 18 passes the at least one capturing module 35, 41, 43 before making contact with the pressure vessel 1 including the top and bottom closures 8, 9.

Figure 2:
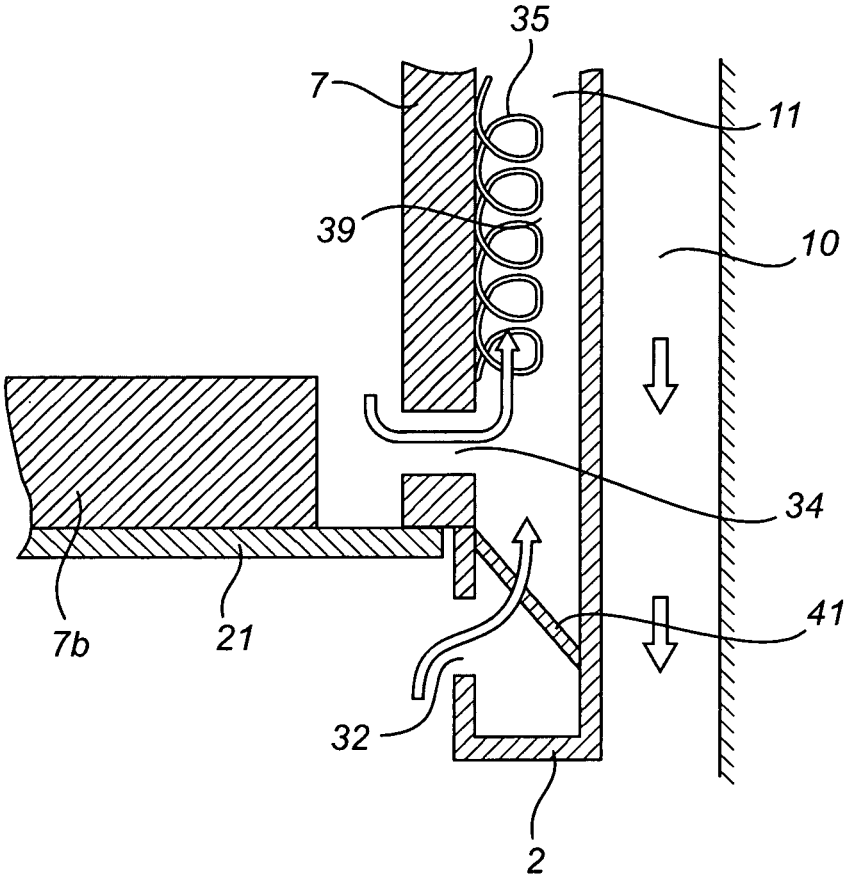
FIG. 2 is a detailed view of the pressing arrangement according to an embodiment of the present invention shown in FIG. 1.
Figure 3:
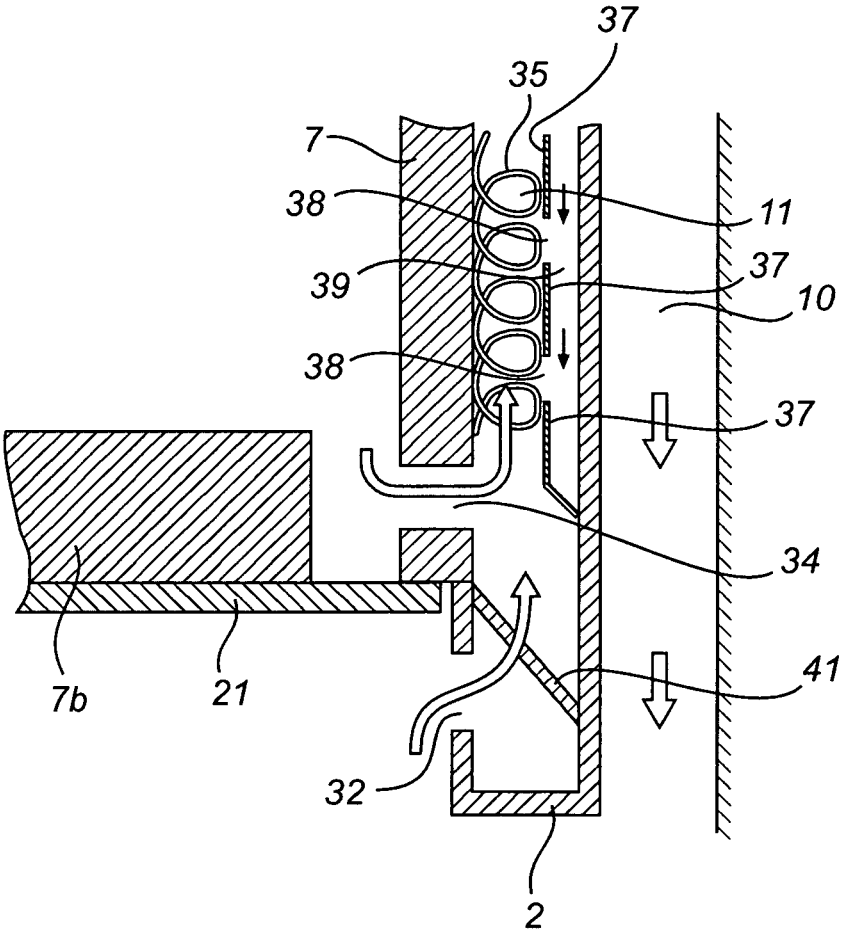
FIG. 3 is a detailed view of the pressing arrangement according to an embodiment of the present invention shown in FIG. 1.

According to the present invention, the substance capturing module includes at least one condensation element 35 is arranged in the first guiding passage 11. The condensation element 35 is constructed such that pressure medium can pass through to allow a condensation process during the upward flow of pressure medium. In FIGS. 2 and 3, a detailed view of an embodiment of the condensation element 35 is shown. According to this embodiment, the condensation element 35 comprises elements capable of creating and attracting condense and creating turbulence in the ascending pressure medium, for example, spring-like, coil-like, or helically shaped elements to thereby capture substances, e.g. dust or gaseous contaminates, carried by the passing pressure medium. Preferably, the condensation elements 35 are arranged on the warmer side of the second guiding passage 11, i.e. on the side of the guiding passage being closest to the furnace chamber 18.

In an embodiment shown in FIG. 3, the condensation element 35 also comprises a partition wall 37 arranged in the second guiding passage 11. The partition wall 37 defines a channel 39 between the partition wall 37 and the housing 2. Further, the partition wall 37 includes a number of apertures or holes 38 allowing a part of the pressure medium to flow into the channel 39 to be re-circulated downwards.

Furthermore, the substance capturing module 35, 41, 43, may comprise at least one first filter 41 is arranged in the second guiding passage 11 between the first or lower hole 32 and the second or upper hole 34. By arranging the first filter 41 between the first or lower hole 32 and the second or upper hole 34 is can be secured that substances from the treated substances, e.g. in case of a container leakage, are not spread within the pressure arrangement 100 in an uncontrolled manner in a downward (or upstream) direction but are captured in the filter 41.

As indicated in FIGS. 1-3, the filter 41 is arranged with an angle relative to the second guiding passage 11 in order to provide a large filter area. Further, the filter 41 may be corrugated.

The first filter 41 may be an electro-static filter or a chemically active filter.

The substance capturing module 35, 41, 43, may also comprise at least one second filter 43 is arranged in the second guiding passage 11 between the upper hole 34 and the at least one opening 13. By arranging the second filter 43 between the upper hole 34 and the at least one opening 13 it can be secured that any substances from container leakage are not spread within the pressure arrangement 100 in an uncontrolled manner.

In one preferred embodiment, the second filter 43 is arranged between the at least one opening 13 in the upper part of the guiding passage and the condensation element 35. Thereby, it can be secured that substances not captured by the condensation element is prevented from passing the central opening by capturing them in the filter 43.

As indicated in FIG. 1, the filter 41 is arranged with an angle relative to the second guiding passage 11 in order to provide a large filter area. Further, the filter 43 may be corrugated.

The second filter 43 may be an electro-static filter or a chemically active filter.

As shown in FIG. 1, the heat insulated casing 3 may be is arranged on the bottom supporting plate 21 to provide sealing between the space 31 below the bottom heat insulating portion 7*b* and the space 23 below the furnace chamber 18. There are other conceivable way of providing the sealing between the space 31 and the space 23, for example, by means of sealing element between the bottom supporting plate 21 and the heat insulated casing 3.

Thereby, it can be secured that pressure medium flowing out from the furnace chamber 18 passes the particle capturing module, which may include the walls of the guiding passage 11, and/or the condensation element 35, and/or the upper filter 43 and/or the lower filter 41. The substances from a leaking container cannot pass downward from the space 23 to the space 31 since primarily the sealing 21 will prevent this and the lower filter 41 provides additional security. Further, the condensation element 35 and the upper filter 43 will prevent substances to pass upward through central opening 13 via the second guiding passage 11. The walls of the heat insulating portion 7 and the housing 2 can be used instead of or as a complement to the condensation element 35 to provide a condensation of substances carried by the pressure medium. Accordingly, in case of a container leakage, the leaking substances will be kept inside the load compartment 19 and the housing 2.

Figure 4:
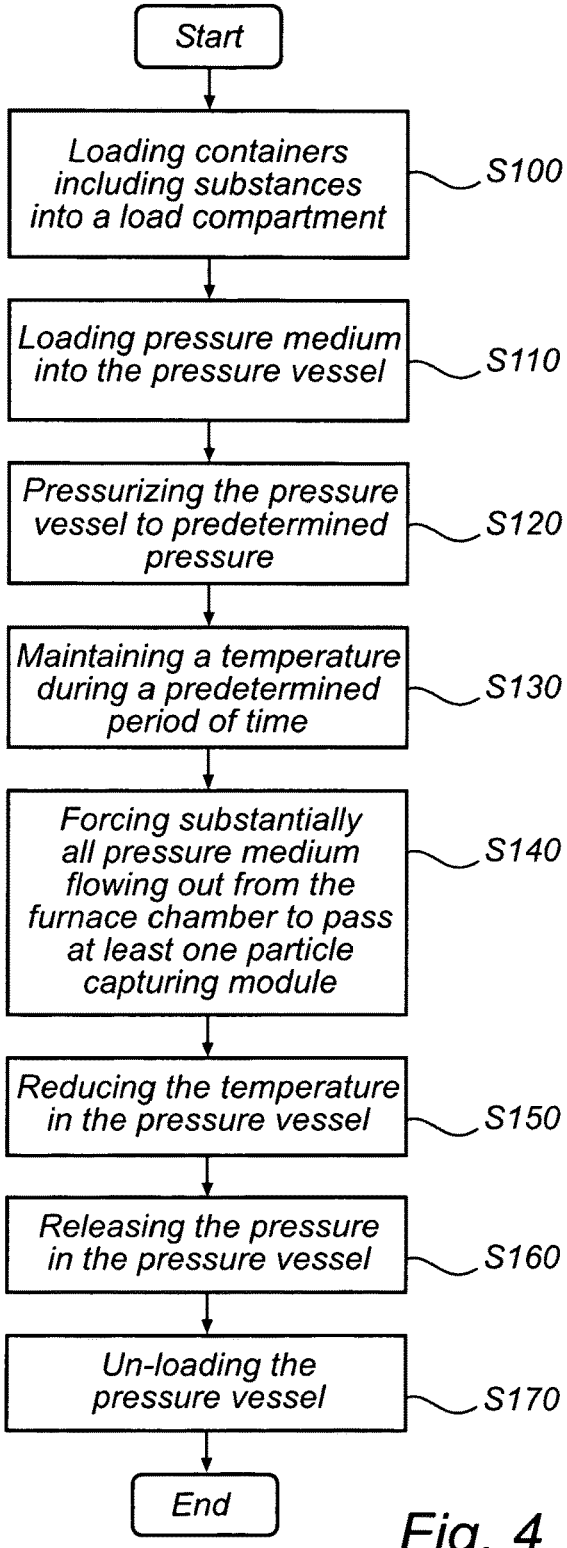
FIG. 4 is a flow chart describing the steps of a method according to the present invention.

With reference now to FIG. 4, the steps of an embodiment of the method according to the present invention will be discussed. In a preferred embodiment of the method for hot pressing of substances according to the present invention, the method is used in a pressing arrangement as shown in FIG. 1-3.

First, at step S100, containers including a substance to be treated by high pressure are placed or loaded into the load compartment 19 of the furnace 18.

At step S110, a pressure medium is loaded or introduced into the pressure vessel 1.

Thereafter, at step S120, the pressure vessel 1 is pressurized to a pressure in range between 200 to 5000 bars, and preferably 800 to 2000 bars, and more preferably 500 to 1500 bars.

At step S130, a temperature of the pressure vessel 1 is increased to a desired temperature in a range from between 300° C. to 3000° C., and preferably from 800° C. to 2000° C. and the temperature is maintained during a predetermined period of time.

Then, at step S140, substantially all pressure medium flowing out from the furnace chamber 18 passes at least one capturing module 35, 41, 43 before making contact with the pressure vessel 1.

At step S150, the temperature within the pressure vessel is reduced.

Subsequently, at step S160, the pressure in the pressure vessel 1 can be released. Thereafter, at step S170, the containers can be removed out from the load compartment 19.

Even though the present description and drawings disclose embodiments and examples, including selections of components, materials, temperature ranges, pressure ranges, etc., the invention is not restricted to these specific examples. Numerous modifications and variations can be made without departing from the scope of the present invention, which is defined by the accompanying claims.

The invention claimed is:

1. A pressing arrangement for hot isostatic pressing of substances, comprising:

a pressure vessel including top and bottom end closures;

a furnace chamber provided inside the pressure vessel and being adapted to hold articles such as containers comprising substances to be treated by hot isostatic pressing, a heat insulated casing including a heat insulating portion, a housing and a bottom heat insulating portion;

a guiding passage being defined by said heat insulating portion and said housing, said guiding passage communicating with the furnace chamber and being a part of an outer cooling loop, wherein said pressure medium is guided toward said top closure in said guiding passage;

at least one upper hole arranged substantially at the same height as said bottom heat insulating portion to allow pressure medium to flow into said guiding passage from said furnace chamber; and at least one substance capturing module adapted to capture substances carried by said pressure medium, wherein said at least one substance capturing module is arranged such that all pressure medium flowing out from said furnace chamber passes said at least one substance capturing module before making contact with said pressure vessel including said top and bottom closures, wherein said at least one substance capturing module is arranged in said outer cooling loop within said housing such that the pressure medium flowing out from said furnace chamber is forced to pass said at least one substance capturing module via said guiding passage before making contact with said pressure vessel; and a sealing arranged between an upper space, which is below the furnace chamber, and a lower space, which is below the bottom heat insulating portion, so as to ensure that the pressure medium flowing out from the furnace chamber is forced to pass the at least one substance capturing module via the guiding passage prior to entering the lower space.

2. The pressing arrangement according to claim 1, wherein said at least one substance capturing module comprises at least one condensation element arranged in said guiding passage, wherein substances carried by said pressure medium can condensate on said condensation element when passing said condensation element.

3. The pressing arrangement according to claim 2, wherein said at least one substance capturing module comprises at least one first filter arranged downstream said at least one upper hole.

4. The pressing arrangement according to claim 3, wherein said at least one first filter is arranged downstream said condensation element and arranged such that said pressure medium passes through said first filter before making contact with said pressure vessel including said top and bottom closures.

5. The pressing arrangement according to claim 3 or 4, wherein said at least one first filter is arranged in said guiding passage between said at least one upper hole and at least one opening in an upper part of said guiding passage.

6. The pressing arrangement according to claim 1, wherein at least one lower hole is arranged below said at least one upper hole in a lower part of the guiding passage.

7. The pressing arrangement according to claim 6, wherein said at least one lower hole is arranged below said sealing to allow colder pressure medium to flow into said guiding passage from a space below said bottom heat insulating portion.

8. The pressing arrangement according to claim 6, wherein said at least one substance capturing module comprises at least one second filter arranged in connection with the at least one lower hole such that substances carried by pressure medium are substantially prevented from entering said space below said bottom heat insulating portion.

9. The pressing arrangement according to claim 8, wherein said least one second filter is arranged in said guiding passage.

10. The pressing arrangement according to any one of claims 3-4 or any one of claims 6-9, wherein said first and/or second filter is an electro-static filter or a chemically active filter.

11. A method for hot pressing of substances using a pressing arrangement, said pressing arrangement including a pressure vessel including top and bottom end closures, a furnace chamber provided inside the pressure vessel and being adapted to hold articles such as containers comprising substances to be treated by hot pressing, and a heat insulated casing including a heat insulating portion, a housing and a bottom heat insulating portion, wherein a guiding passage is defined by said heat insulating portion and said housing, said guiding passage communicating with the furnace chamber and being a part of an outer cooling loop, said heat insulating portion and said bottom heat insulating portion being arranged to enclose said furnace chamber, the pressing arrangement further comprising a sealing arranged between an upper space, which is below the furnace chamber, and a lower space, which is below the bottom heat insulating portion, the sealing being arranged so as to ensure that the pressure medium flowing out from the furnace chamber is forced to pass the at least one substance capturing module via the guiding passage prior to entering the lower space, said method comprising:

placing containers including said substances in a load compartment in said furnace;

loading a pressure medium into said pressure vessel;

pressurizing said pressure vessel to a pressure between 200 to 5000 bars, and preferably 800 to 2000 bars, and more preferably 500 to 1500 bars;

maintaining temperature in said pressure vessel from between 300° C. to 3000° C., and preferably from 800° C. to 2000° C.;

conveying all pressure medium flowing out from said furnace chamber such that the pressure medium passes at least one substance capturing module via said guiding passage of the outer cooling loop within said housing before making contact with said pressure vessel including said top and bottom closures, wherein the sealing ensures that the pressure medium flowing out from the furnace chamber is forced to pass the at least one substance capturing module via the guiding passage prior to entering the lower space below the bottom heat insulating portion;

reducing said temperature within the pressure vessel; and releasing pressure in said pressure vessel.

12. The method according to claim 11, further comprising conveying substantially all said pressure medium flowing out from said furnace chamber to pass at least one condensation element of said substance capturing module arranged in said guiding passage, wherein substances carried by said pressure medium can condensate on said condensation element when passing said condensation element.

13. The method according to claim 11 or 12, further comprising conveying substantially all pressure medium flowing out from said furnace chamber to pass at least one first filter arranged downstream said at least one upper hole.

14. The method according to claim 11 or 12 further comprising conveying cold pressure medium through at least one lower hole arranged below the sealing to flow into said guiding passage from said lower space below said bottom heat insulating portion.

* * * * *